US010660817B2

(12) United States Patent
Johnson

(10) Patent No.: US 10,660,817 B2
(45) Date of Patent: May 26, 2020

(54) SPINE MOBILIZATION SYSTEM

(71) Applicant: Innovative Health Creations LLC, Windsor, CO (US)

(72) Inventor: Scott A. Johnson, Windsor, CO (US)

(73) Assignee: Innovative Health Creations LLC, Windsor, CO (US)

( * ) Notice: Subject to any disclaimer, the term of this patent is extended or adjusted under 35 U.S.C. 154(b) by 1127 days.

(21) Appl. No.: 14/880,370

(22) Filed: Oct. 12, 2015

(65) Prior Publication Data

US 2017/0100298 A1 Apr. 13, 2017

(51) Int. Cl.
*A61H 1/00* (2006.01)
*A61H 1/02* (2006.01)

(52) U.S. Cl.
CPC ... *A61H 1/0292* (2013.01); *A61H 2201/1284* (2013.01); *A61H 2201/168* (2013.01); *A61H 2203/0456* (2013.01)

(58) Field of Classification Search
CPC ..... A61H 1/0292; A61H 2201/168; A61H 2203/0456; A61H 2201/1284; A61H 1/008; A61H 2201/1623; A61H 2205/081; A61H 2201/0134
See application file for complete search history.

(56) References Cited

U.S. PATENT DOCUMENTS 712,375 A * 10/1902 Hartford ..... A61H 1/008 606/240
726,054 A * 4/1903 Hartford ..... A61H 1/008 5/417
726,055 A * 4/1903 Hartford ..... A61H 1/008 5/185
1,572,794 A * 2/1926 Hamilton ..... A61H 15/00 601/122
1,833,426 A * 11/1931 Knudson ..... A61H 7/001 601/134
4,230,099 A * 10/1980 Richardson ..... A61F 5/01 606/240
4,572,578 A * 2/1986 Perkins ..... A47C 7/46 297/452.32
4,705,030 A * 11/1987 Tepperberg ..... A61H 1/008 601/134
4,736,735 A * 4/1988 Yong ..... A61H 23/0218 601/49
4,928,335 A * 5/1990 Pedrow ..... A47G 9/10 5/421
D312,694 S * 12/1990 Yanazaki ..... D24/215
5,007,414 A * 4/1991 Sexton ..... A61F 5/01 602/19

(Continued)

FOREIGN PATENT DOCUMENTS

DE 202008002878 8/2008

OTHER PUBLICATIONS

Lee. Kinematics of rotational mobilisation of the lumbar spine. Clinical Biomechanics 16 (2001) 481-488.

(Continued)

*Primary Examiner* — Tu A Vo
(74) *Attorney, Agent, or Firm* — Craig R. Miles; CR Miles P.C.

(57) ABSTRACT

A spine mobilization apparatus capable of supporting a spine segment to allow posteroanterior or rotational mobilization of one or more vertebra of the spine.

3 Claims, 18 Drawing Sheets

(56) References Cited

U.S. PATENT DOCUMENTS 5,007,633 A * 4/1991 Lemire ..... A63B 21/078 482/142
5,033,137 A * 7/1991 Pedrow ..... A47G 9/10 5/636
D321,402 S * 11/1991 Hoshino ..... D24/188
5,070,865 A * 12/1991 Iams ..... A47G 9/10 128/DIG. 20
5,273,510 A * 12/1993 Puckett ..... A63B 21/00047 482/142
5,279,310 A * 1/1994 Hsien ..... A61F 5/01 128/DIG. 20
5,584,786 A * 12/1996 Almeda ..... A63B 21/00047 482/140
5,820,573 A * 10/1998 Ramos ..... A61H 7/001 601/134
5,925,003 A * 7/1999 Vincent ..... A61H 1/0218 601/134
6,036,719 A * 3/2000 Meilus ..... A61H 1/008 601/134
6,041,457 A * 3/2000 Summers ..... A47C 7/425 297/452.29
6,154,902 A * 12/2000 Russillio ..... A61G 7/065 5/623
6,623,270 B1 * 9/2003 Meldeau ..... A63B 21/00047 432/140
8,323,223 B1 * 12/2012 Woggon ..... A61H 1/0218 601/49
8,696,607 B2 * 4/2014 McDonnell ..... 128/845
8,911,388 B2 * 12/2014 Mooney ..... A61F 5/04 128/870
9,033,416 B1 * 5/2015 Vanderhorst ..... A47C 7/46 297/284.5
2003/0120188 A1 * 6/2003 Kusumi ..... A61F 5/01 601/115
2004/0078055 A1 * 4/2004 Kusumi ..... A61F 5/01 606/240
2004/0204742 A1 * 10/2004 Graham, D.C. ..... A61H 1/0218 606/240
2005/0131462 A1 * 6/2005 Kalina ..... A61H 1/008 606/240
2007/0173391 A1 * 7/2007 Edwards ..... A63B 21/00047 482/142
2007/0181122 A1 * 8/2007 Mulier ..... A61G 13/12 128/202.16
2007/0276438 A1 * 11/2007 Meglin ..... A61H 1/0292 606/237
2009/0051199 A1 * 2/2009 Crosbie ..... A47C 7/40 297/230.11
2009/0259151 A1 * 10/2009 McDonnell ..... 601/56
2009/0270914 A1 * 10/2009 Heikkila ..... A61H 1/0292 606/237
2010/0236560 A1 * 9/2010 Rambo ..... A61F 5/01 128/845
2012/0179201 A1 * 7/2012 Segur ..... A61H 1/008 606/237
2012/0280545 A1 * 11/2012 Vernon ..... A47C 7/425 297/230.1
2013/0046343 A1 * 2/2013 Adamski ..... A61H 1/008 606/240
2013/0276793 A1 * 10/2013 Patton ..... A61G 13/1295 128/845
2014/0180331 A1 * 6/2014 Turner ..... A61H 1/008 606/204
2015/0005677 A1 * 1/2015 Liao ..... A61H 1/0222 601/5
2015/0047646 A1 * 2/2015 Marinkovic ..... A61H 1/008 128/845
2016/0136478 A1 * 5/2016 Yu ..... A63B 21/4039 482/121
2017/0347803 A1 * 12/2017 Krishtul ..... A47C 7/425

OTHER PUBLICATIONS

Patent Cooperation Treaty International Patent Application No. PCT/US16/55744, filed Oct. 6, 2016.

Patent Cooperation Treaty International Patent Application No. PCT/US16/55744; International Search Report and Written Opinion of the International Searching Authority, dated Jan. 12, 2017; 9 pages.

Wrought Iron Hardware. Retrieved from the Internet: <https:1fweb.archive.org/web/20141202002039/http:/www.cozyhomeoriginals.com/index_wrought_iron.html)>; downloaded on Dec. 4, 2016; 39 pages.

American Sign Language Manual Alphabet Desktop Wallpaper. Retrieved from the Internet: <https://web.archive.org/web/20060701102004/http://www.lifeprint.com/asl101/topics/wallpaper1.htm>; downloaded on Dec. 6, 2016; 3 pages.

* cited by examiner

SPINE MOBILIZATION SYSTEM

I. FIELD OF THE INVENTION

Generally, a spine mobilization device including first and second lateral spinal support portions joined by a medial recessed portion which defines a medial open space configured to receive a plurality of spinous processes of a segment of the spine with the first and second lateral spinal support portions each supporting one of two transverse processes projecting from each vertebrae on opposite sides of each corresponding spinous process of the segment of the spine and an axial spinal support member projecting from the first lateral spinal support to cross the longitudinal axis of the medial recessed portion.

II. BACKGROUND OF THE INVENTION

The vertebrate spinal column includes a series of vertebrae extending from the skull to the small of the back enclosing the spinal cord and providing support for the thorax and abdomen. Each vertebra is an irregular bone with a complex structure composed of bone and some hyaline cartilage. The proportions of each vertebra can vary according to the location in the spinal column and between individual animals.

The basic structure of a vertebra comprises a vertebra body including a main anterior bony part that consists of the centrum, the ossified posterolateral joints linking the centrum and each half of the neural arch, and part of the neural arch. The upper and lower surfaces of the vertebra body give attachment to the intervertebral discs. The posterior part of a vertebra forms a vertebral arch, consisting of two pedicles, two laminae, and seven processes. The laminae give attachment to the ligamenta flava. There are vertebral notches formed from the shape of the pedicles, which form the intervertebral foramina when the vertebrae articulate. These foramina are the entry and exit conduits for the spinal nerves. The body of the vertebra and the vertebral arch form the vertebral foramen, the larger, central opening that accommodates the spinal canal, which encloses and protects the spinal cord. The spinous process is directed backward and downward from the junction of the laminae, and serves for the attachment of muscles and ligaments. The articular processes, two superior and two inferior, spring from the junctions of the pedicles and laminae. The superior project upward, and their articular surfaces are directed more or less backward; the inferior project downward, and their surfaces look more or less forward. The transverse processes, two in number, project one at either side from the point where the lamina joins the pedicle, between the superior and inferior articular processes. They serve for the attachment of muscles and ligaments. Vertebrae articulate with each other to give strength and flexibility to the spinal column, and the shape at their back and front aspects determines the range of movement.

Spinal manipulative therapy is a "hands-on" treatment of the spine in which the therapist moves the vertebrae within the physiological range of motion. The therapist may use slow, passive movements, starting with a small range and gradually increasing to a larger range of motion or the therapist may apply specifically directed manual impulse, or thrust, to a joint, at or near the end of the physiological range of motion. Typically, spinal manipulative therapy includes posteroanterior mobilization of the vertebra largely confined to the sagittal plane of the spine and rotational mobilization which involves complex three dimensional movements and loading resulting in axial rotation and movement in other planes. The spinal posture during spinal manipulative therapy can have a significant influence on the movement of the spine. Lee, Raymond Y. W., Kinematics of rotational mobilization of the lumbar spine, Clinical Biomechanics 16 (2001) 481-488.

Accordingly, a wide variety of devices are available to assist in fixing the spinal posture during spinal manipulative therapy. As an illustrative example, mobilization wedges may utilized to orient the articular surfaces for passive or active joint mobilization. Typically, a mobilization wedge will have a thick end and a thin end joining two principal flat faces meeting in an acute angle. For spinal mobilization, the wedges often have a cut out disposed axially and medially in one of the two faces. The cut out provides a space in which the spinous process of a vertebral segment can be located while the edges of the cut out which join the flat face block the transverse processes.

The structure of conventional mobilization wedges may introduce shortfalls and risks in spinal manipulative therapy. A first aspect can be that the height of the thick end joining the two principal faces of the mobilization wedge may allow excessive posteroanterior mobilization of the vertebra in the sagittal plane between supported and unsupported spinal segments. A second aspect can be that that the flat face of the wedge extending outward on opposite sides of the cut out terminates axially at the thick end of the wedge. Thus, in an adjoining pair of vertebrae disposed proximate the thick end of the wedge, a first vertebrae supported by the wedge can have both transverse processes supported by the flat face on either side of the cut out while the second vertebrae unsupported by the wedge can have neither transverse process supported by the face on either side of the wedge. Accordingly, the rotational movement of the unsupported vertebrae can be in either direction about the axis of the spinal column when the therapy is directed only in one direction about the axis of the spinal column. A third aspect can be that the wedge may not include any supporting member which extends outward axially or laterally from the thick end of the wedge.

SUMMARY OF THE INVENTION

A broad object of particular embodiments of the invention can be to provide a spine mobilization apparatus including first and second lateral spinal support portions joined by a medial recessed portion which defines a medial open space configured to receive a plurality of spinous processes of a segment of the spine with the first and second lateral spinal support portions each supporting one of two transverse processes projecting from each vertebrae on opposite sides of each corresponding spinous process of the segment of the spine and including an axial spinal support member projecting from the first lateral spinal support to cross the longitudinal axis of said medial recessed portion providing the advantage of supporting the portion of the spinal column that extends beyond the end of the first and second lateral support segments to reduce or avoid excessive posteroanterior mobilization of a vertebra in the sagittal plane between supported and unsupported spinal segments.

Another broad object of particular embodiments of the invention can be to provide a spine mobilization apparatus including first and second lateral spinal support portions joined by a medial recessed portion which defines a medial open space configured to receive a plurality of spinous processes of a segment of the spine with the first and second lateral spinal support portions each supporting one of two transverse processes projecting from each vertebrae on opposite sides of each corresponding spinous process of the segment of the spine and in which the lateral spinal support first ends terminate at about the same location along the longitudinal axis defined by the medial recessed portion and in which the lateral spinal support second ends termination in offset relationship along the longitudinal axis defined by the medial recessed portion providing the advantage of supporting one of the pair of transverse processes of vertebrae with the longer one of the first or second lateral support portions and providing lesser support of the other one of the pair of transverse processes of the vertebrae with the shorter one of the first or second lateral support portions to increase the likelihood, induce, direct or control rotation or three dimensional movement of a vertebrae or spinal segment in a clockwise or counter clockwise direction depending on whether the offset of the lateral spinal support second ends occurs in the first lateral support portion (the second lateral support portion second end extends beyond the first lateral support portion second end) or in the second lateral support portion (the first lateral support portion second end extends beyond the second lateral support portion second end).

A broad object of particular embodiments of the invention can be to provide a spine mobilization apparatus including first and second lateral spinal support portions joined by a medial recessed portion which defines a medial open space configured to receive a plurality of spinous processes of a segment of the spine with the first and second lateral spinal support portions having offset lateral support second ends and including an lateral spinal support member which projects laterally outward from the extending lateral spinal support portion and disposed adjacent to the offset lateral spinal support second end and extending a distance beyond the lateral side of the offset spinal support second end providing the advantage of supporting the vertebrae that rotates in the direction of the offset lateral support second end to reduce or avoid excessive rotational or three dimensional mobilization of a vertebra or spinal segment in a clockwise or a counterclockwise direction.

Another broad object of particular embodiments of the invention can be to provide a spine mobilization apparatus in both left handed or right handed configurations which provide non-superimposable mirror images of each other to provide embodiments of the spine mobilization apparatus which induce similar forces but on opposite sides of a vertebrae or spinal segment.

Another broad object of particular embodiments of the invention can be to provide a spine mobilization apparatus in left handed and right handed embodiments having certain components shaped like the human hand to afford the advantage of ready determination of the position of a vertebrae or the spine segment in relation to the mobilization apparatus to result in an pre-determined amount or direction of mobilization of a vertebrae or a spine segment.

Naturally, further objects of the invention are disclosed throughout other areas of the specification, drawings, photographs, and claims.

DETAILED DESCRIPTION OF THE INVENTION

Figure 1:
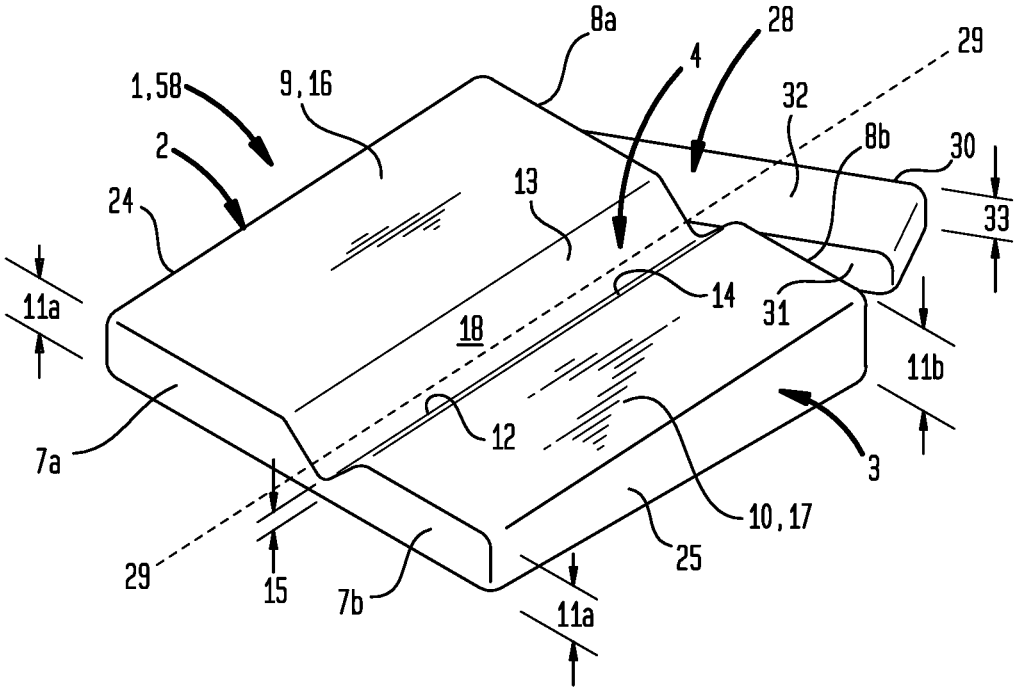
FIG. 1 is a perspective view of an embodiment of the inventive spine mobilization apparatus.
Figure 2:
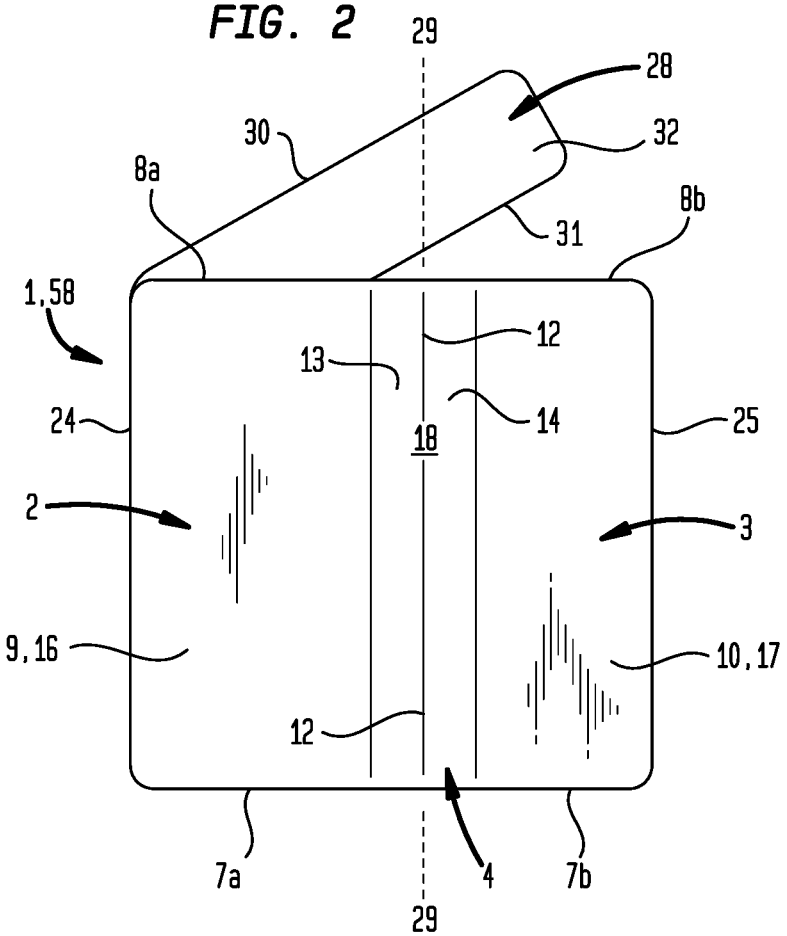
FIG. 2 is a top plan view of an embodiment of the inventive spine mobilization apparatus shown in FIG. 1.
Figure 3:
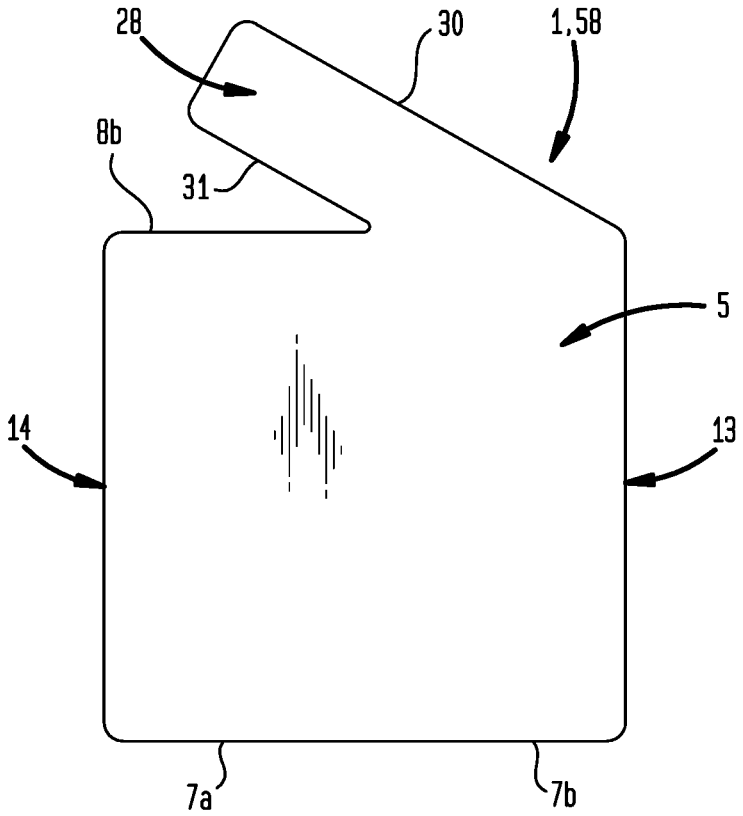
FIG. 3 is a bottom plan view of an embodiment of the inventive spine mobilization apparatus shown in FIG. 1.
Figure 4:
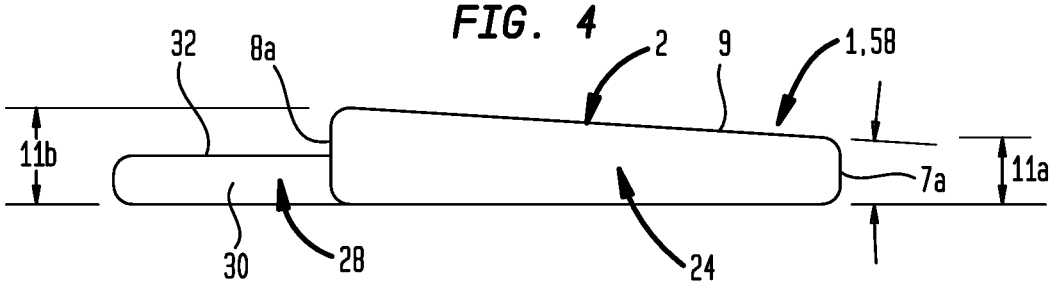
FIG. 4 is a first side view of an embodiment of the inventive spine mobilization apparatus shown in FIG. 1.
Figure 5:
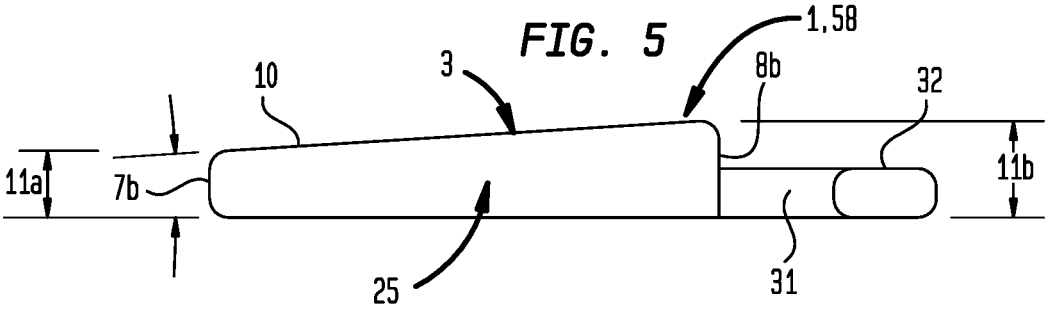
FIG. 5 is a second side view of an embodiment of the inventive spine mobilization apparatus shown in FIG. 1.
Figure 6:
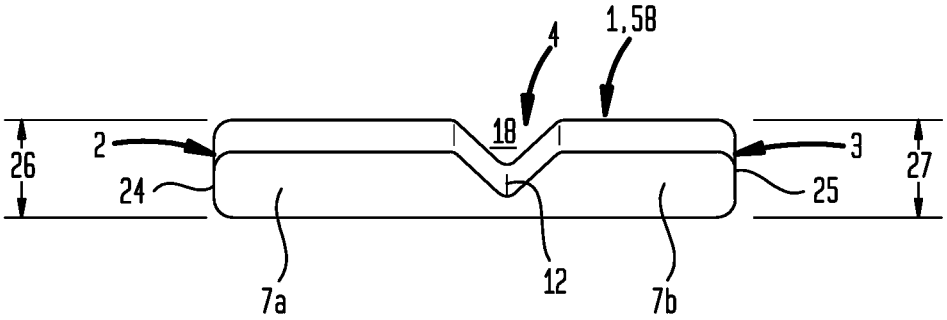
FIG. 6 is a first end view of an embodiment of the inventive spine mobilization apparatus shown in FIG. 1.
Figure 7:
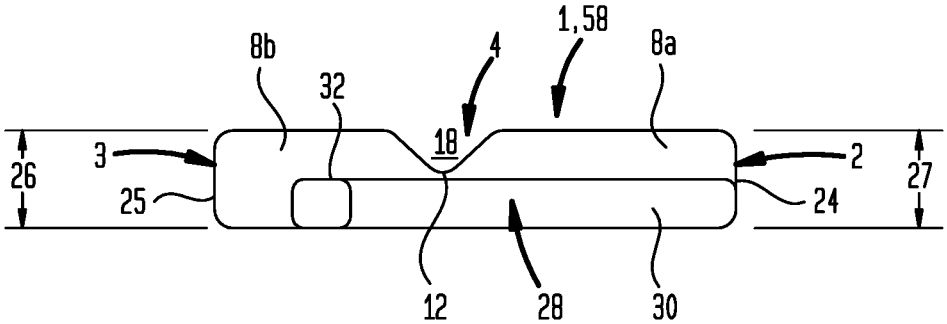
FIG. 7 is a second end view of an embodiment of the inventive spine mobilization apparatus shown in FIG. 1.
Figure 8:
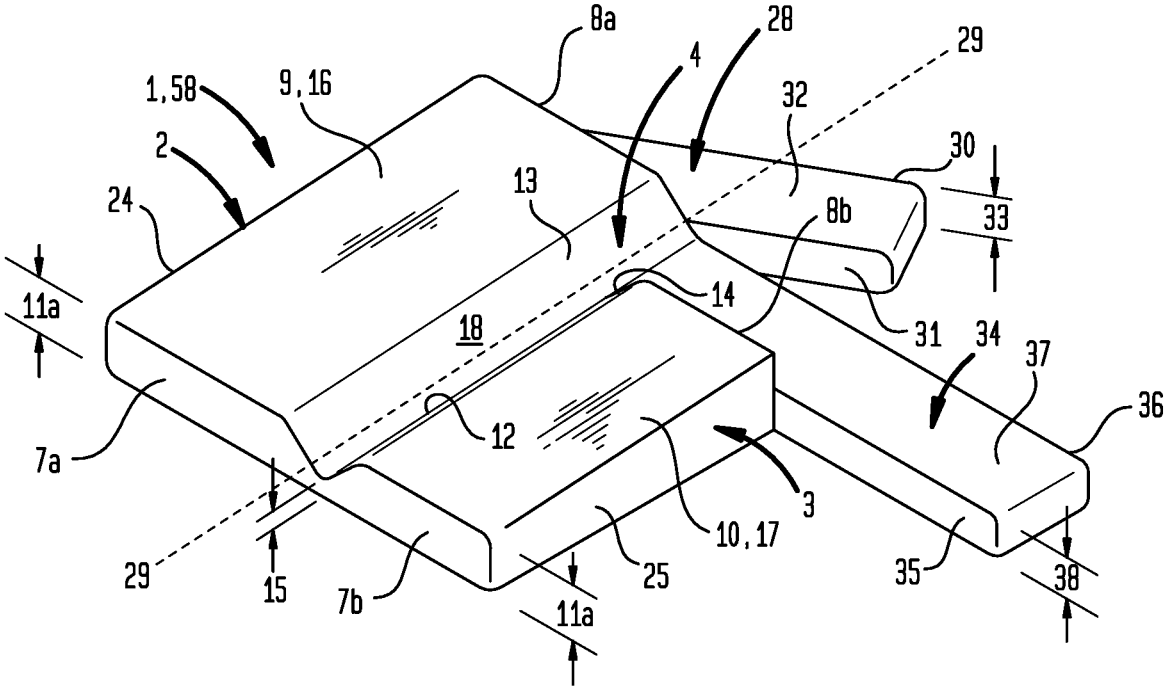
FIG. 8 is a perspective view of an embodiment of the inventive spine mobilization apparatus.
Figure 9:
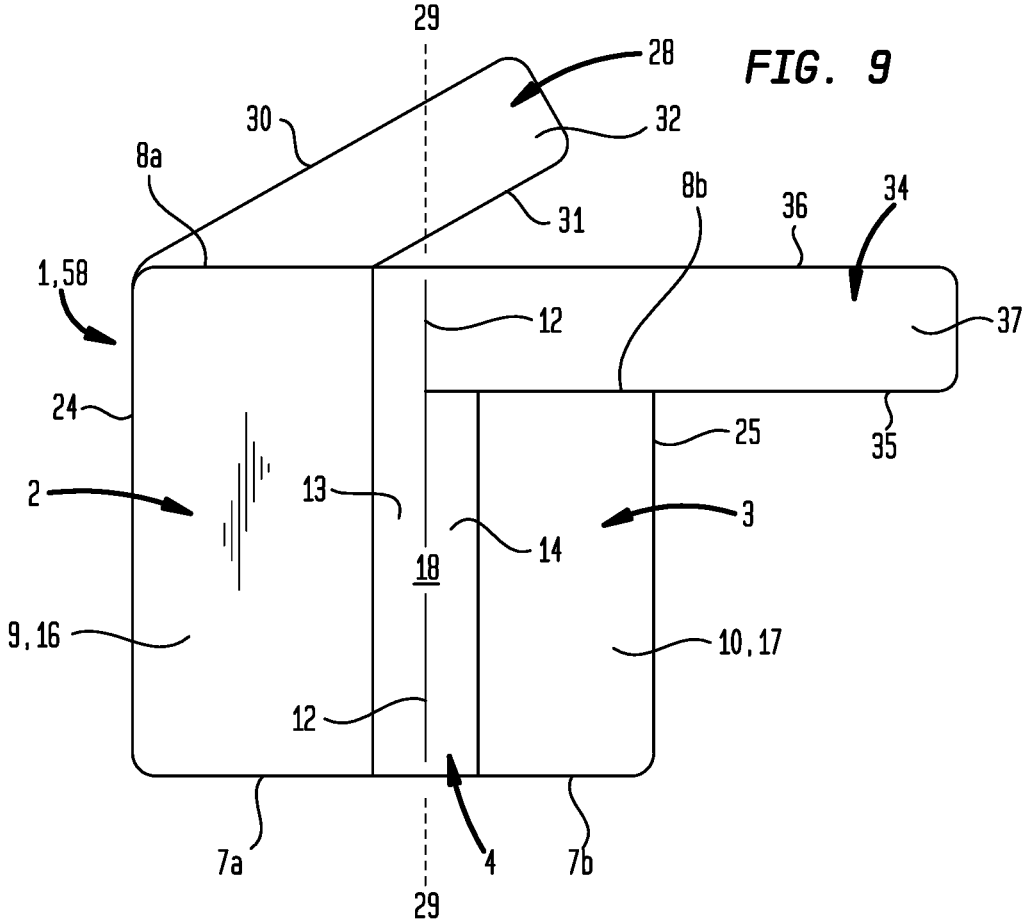
FIG. 9 is a top plan view of the embodiment of the inventive spine mobilization device shown in FIG. 8.
Figure 10:
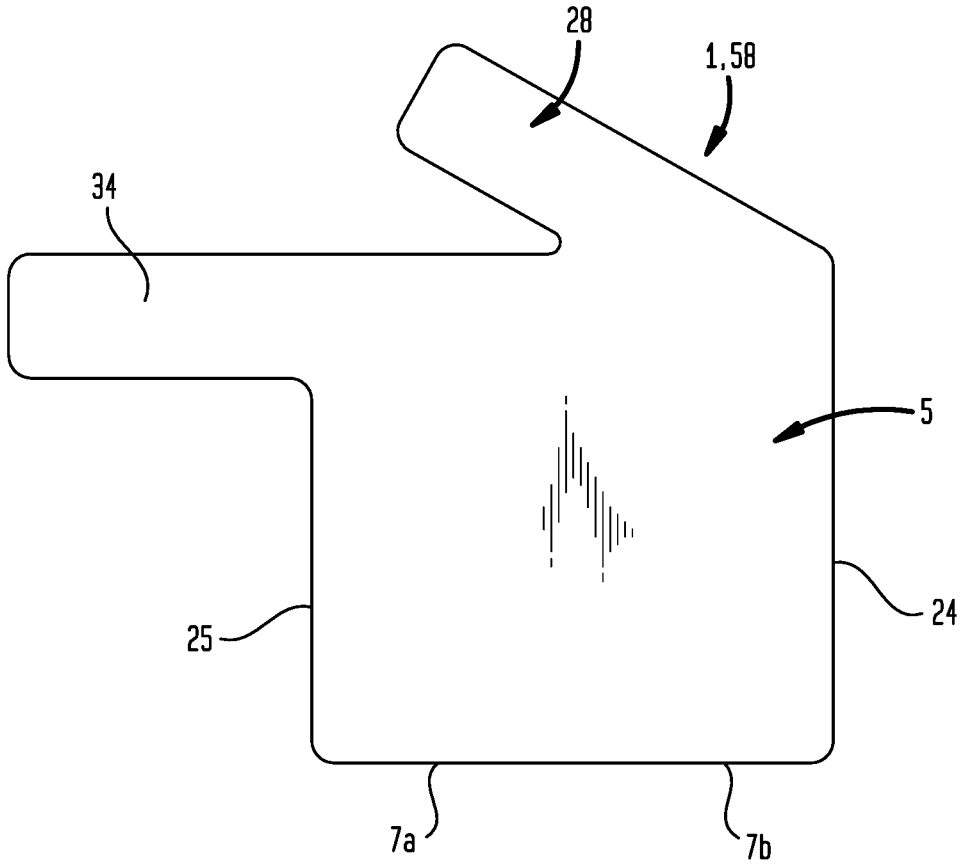
FIG. 10 is a bottom plan view of the embodiment of the inventive spine mobilization device shown in FIG. 8.
Figure 11:
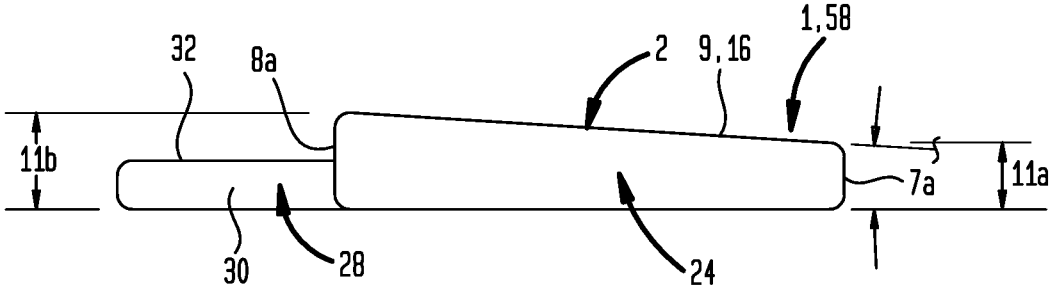
FIG. 11 is a first side view of an embodiment of the inventive spine mobilization apparatus shown in FIG. 8.
Figure 12:
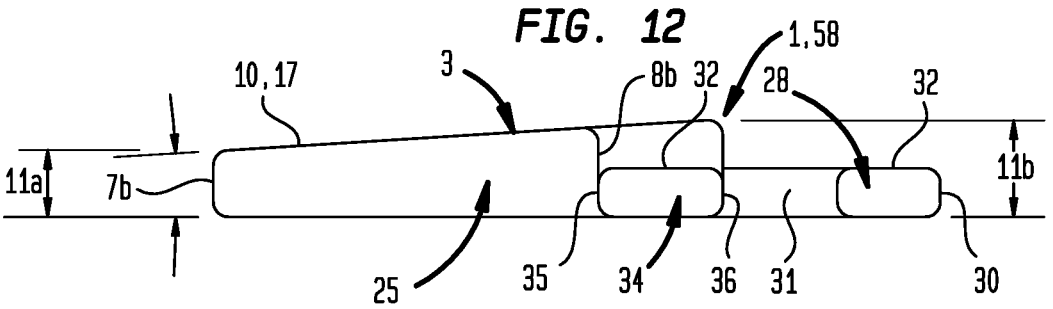
FIG. 12 is a second side view of an embodiment of the inventive spine mobilization apparatus shown in FIG. 8.
Figure 13:
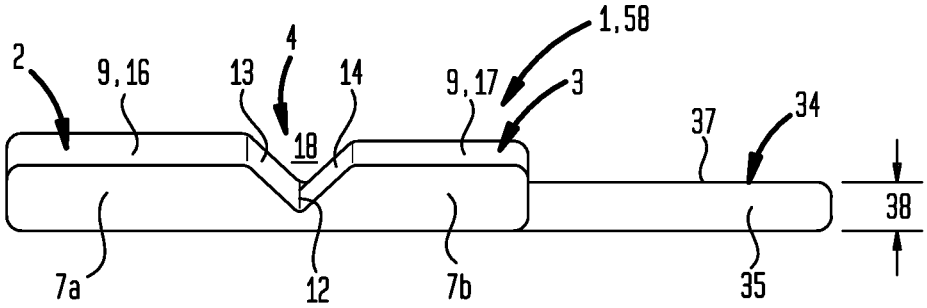
FIG. 13 is a first end view of an embodiment of the inventive spine mobilization apparatus shown in FIG. 8.
Figure 14:
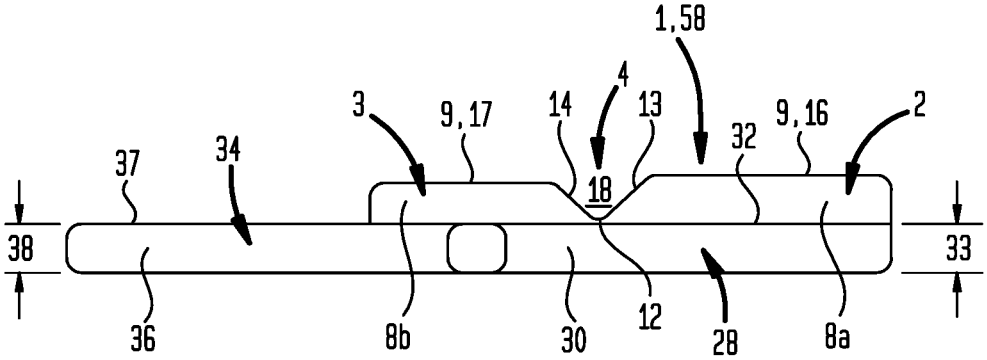
FIG. 14 is a second end view of an embodiment of the inventive spine mobilization apparatus shown in FIG. 8.

Now referring primarily to FIGS. 1 through 14, particular embodiments of the inventive spinal support apparatus (1) include a first lateral spinal support portion (2) and a second lateral support portion (3) joined by a medial recessed portion (4). The first and second lateral support portions (2)(3) and the medial recessed portion (4) can, but need not necessarily, share a flat coextensive base (5) which allows the spinal support apparatus (1) to be positioned on a substantially flat support surface (6) such as a mobilization table (7) (as shown in the examples of FIGS. 30-33). Each of the first and second lateral support portions (2)(3) have opposite lateral spinal support first and second ends (7*a*)(7*b*)(8*a*)(8*b*) each extending upwardly from the base (5) to correspondingly join first and second lateral spinal support faces (9)(10). The lateral spinal support first ends (7*a*)(7*b*) and the lateral spinal support second ends (8*a*)(8*b*) can, but need not necessarily have, substantially the same lateral spinal support first and second end heights (11*a*)(11*b*) disposing each of the first and second lateral spinal support faces (9)(10) in substantially axial horizontal relation to the base (5) As shown in the example of FIGS. 1 through 7, particular embodiments can have lateral spinal support first ends (7*a*)(7*b*) of lesser lateral spinal support first end heights (11*a*) than the lateral spinal support second end heights (11*b*) relative to the base (5). As to these embodiments, the first and second spinal support faces (9)(10) can taper axially toward the base (5) from the lateral spinal support second ends (8*a*)(8*b*) to the lateral spinal support first ends (7*a*)(7*b*) (as shown in the examples of FIGS. 4-5 and 11-12).

Figure 30:
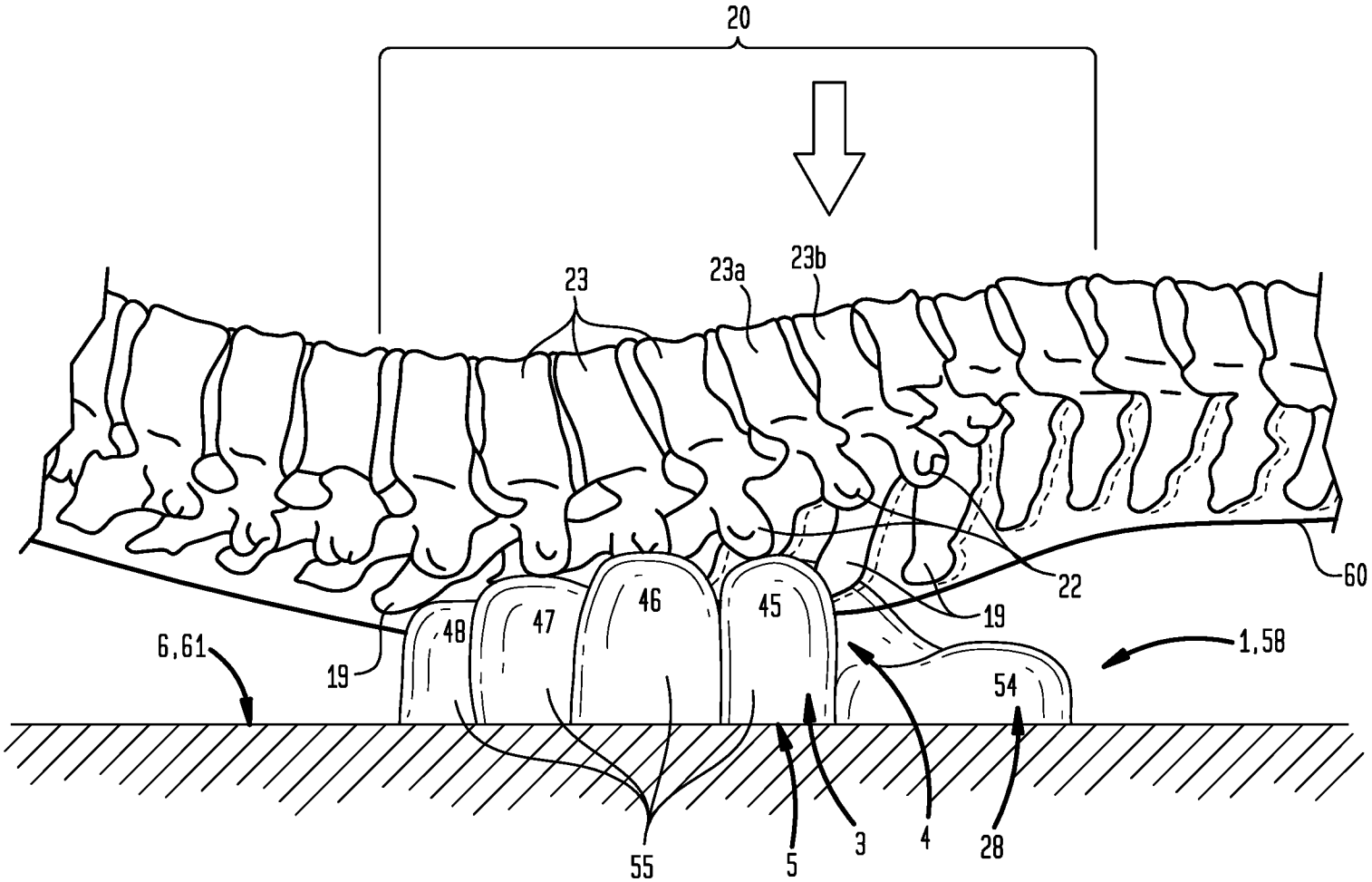
FIG. 30 is an illustration of a method of using the left handed embodiment of the inventive spine mobilization apparatus shown in FIG. 16A.

The medial recessed portion (4) can be configured to include a recess base (12) joining a pair of ascending recess sidewalls (13)(14) which correspondingly join the first lateral spinal support face (9) and the second lateral spinal support face (10). The medial recessed portion (4) can be configured to dispose the recess base (12) at a recess base elevation (15) lesser than either of the a first lateral spinal support elevation (16) of the first lateral spinal support face (9) and a second lateral support elevation (17) of the second lateral spinal support face (10) to provide a medial portion open space (18) of sufficient volume to receive a plurality of spinous processes (19) of a spine segment (20) when the first lateral spinal support portion (2) and the second lateral spinal support portion (3) are each correspondingly supporting one of two transverse processes (21)(22) projecting from each vertebrae (23) on opposite sides of each corresponding one of the plurality of spinous processes (19) of the spine segment (20) (as shown in the example of FIG. 30).

The first lateral spinal support portion (2) and a second lateral support portion (3) can correspondingly include a first lateral side (24) and a second lateral side (25) extending upwardly from the base (5) to correspondingly join the first and second lateral spinal support faces (9)(10). The first lateral side (24) and the second lateral side (25) can correspondingly have a similar first and second lateral side height (26)(27) which disposes each of the first and second lateral spinal support faces (9)(10) in substantially lateral horizontal relation to the base (5).

Again referring primarily to FIGS. 1 through 14, particular embodiments can, but need not necessarily, include an axial spinal support member (28) which projects outward from the first lateral spinal support second end (8*a*) (or from both the first and second lateral spinal support second ends (8*a*)(8*b*)) to cross the longitudinal axis (29) of the medial recessed portion (4). Without reducing the breadth of the forgoing, as to particular embodiments, the axial spinal support member (28) can share the flat coextensive base (5) and include an axial spinal support member first side (30) opposite an axial spinal support member second side (31) each extending upwardly from the base (5) to join an axial spinal support member face (32) having an axial spinal support member elevation (33) at the longitudinal axis (29) of about the same height as the recess base elevation (15). The axial spinal support member (28) can provide support to a portion of the spine segment (20) extending beyond the lateral spinal support second ends (8*a*)(8*b*).

Now referring primarily to FIGS. 1 through 7, as to particular embodiments, the first and second lateral spinal support portions (2)(3) can, but not necessarily, terminate substantially coextensively (neither being substantially longer than the other) at each of a lateral spinal support first ends (7*a*)(7*b*) and lateral spinal support second ends (8*a*)(8*b*) such that neither of the first or second lateral support portions (2)(3) have a corresponding lateral spinal support first end (7*a*)(7*b*) or lateral spinal support second end (8*a*)(8*b*) that is substantially offset a distance beyond the other.

Now referring primarily to FIGS. 8 through 14, as to particular embodiments, the first and second lateral spinal support portions (2)(3) can, but need not necessarily, have either lateral spinal support first ends (7*a*)(7*b*) or lateral spinal support second ends (8*a*)(8*b*) that terminate substantially coextensively as above described while the opposite corresponding lateral spinal support first ends (7*a*)(7*b*) or lateral spinal support second ends (8*a*)(8*b*) are axially offset in relation to one another.

Now referring primarily to FIGS. 8 through 14, particular embodiments of the spinal support apparatus (1) which include lateral spinal support first ends (7*a*)(7*b*) which terminate substantially coextensively, as above described, while the lateral spinal support second ends (8*a*)(8*b*) are axially offset in relation to one another can, but need not necessarily, include the axial spinal support member (28), as above described, and can but need not necessarily include, a lateral spinal support member (34) which projects laterally outward from the first lateral spinal support portion (2) adjacent to the second lateral spinal support second end (8*b*) and extending a distance beyond second lateral side (25) of the second spinal support portion (3). The lateral spinal support member (34) can have a first and second lateral spinal support member sides (35)(36) which extend from the base (5) to join a lateral spinal support member face (37) having a lateral spinal support member height (38) adjacent the second lateral spinal support second end (8*b*) at about the recess base elevation (15). The overall length of the lateral spinal support member (24) can be of a greater or lesser length depending on the application.

Accordingly, particular embodiments, can have lateral spinal support first ends (7*a*)(7*b*) or lateral spinal support second ends (8*a*)(8*b*) axially offset in relation to one another exclusive of the an axial spinal support member (28) and a lateral spinal support member (34), or inclusive of one or the other of the axial spinal support member (28) and the lateral spinal support member (34), or inclusive of both the axial spinal support member (28) and the lateral spinal support member (34).

Figure 15:
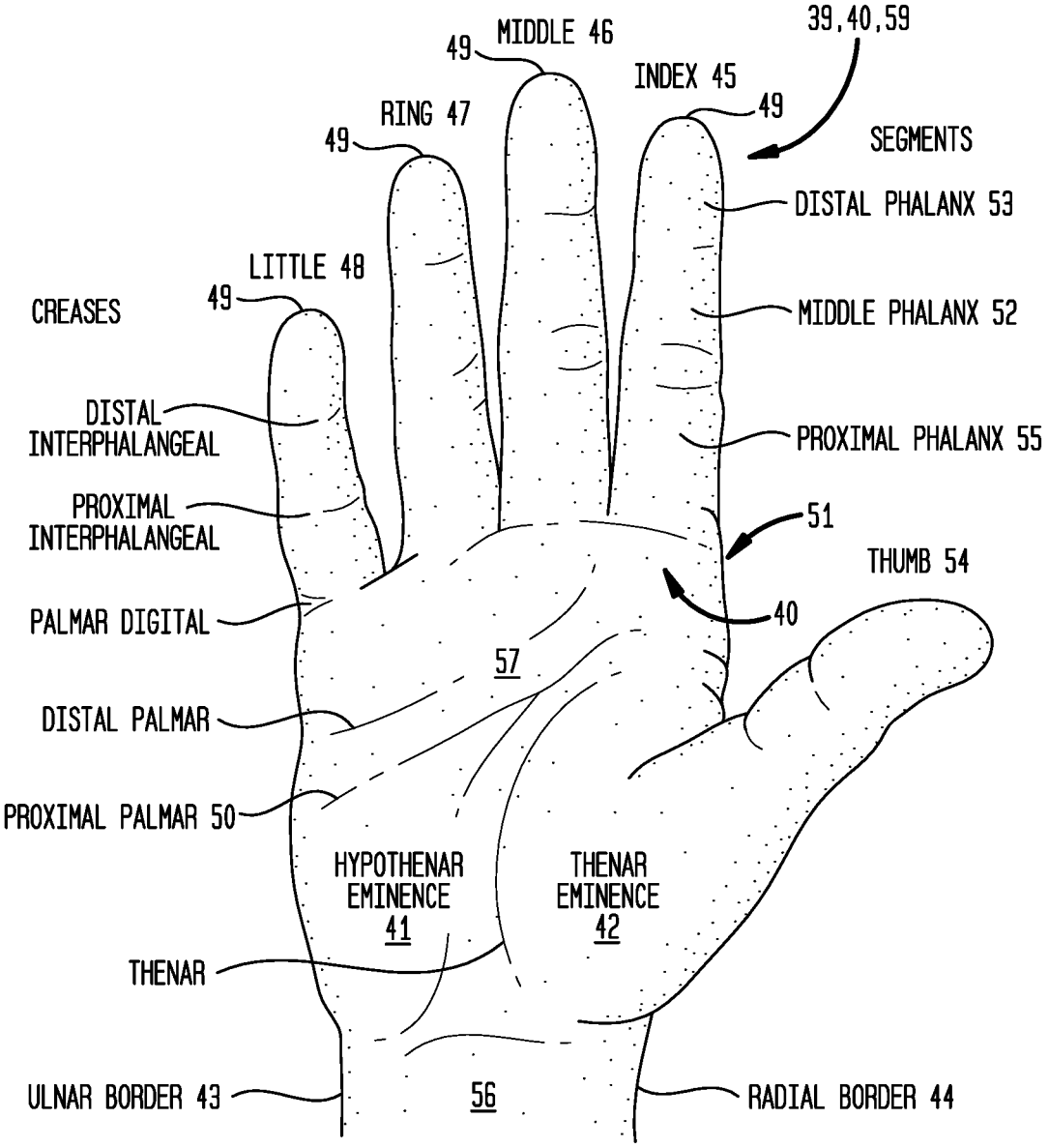
FIG. 15 is an illustration identifying certain creases, segments, and parts of the human hand.
Figure 16A:
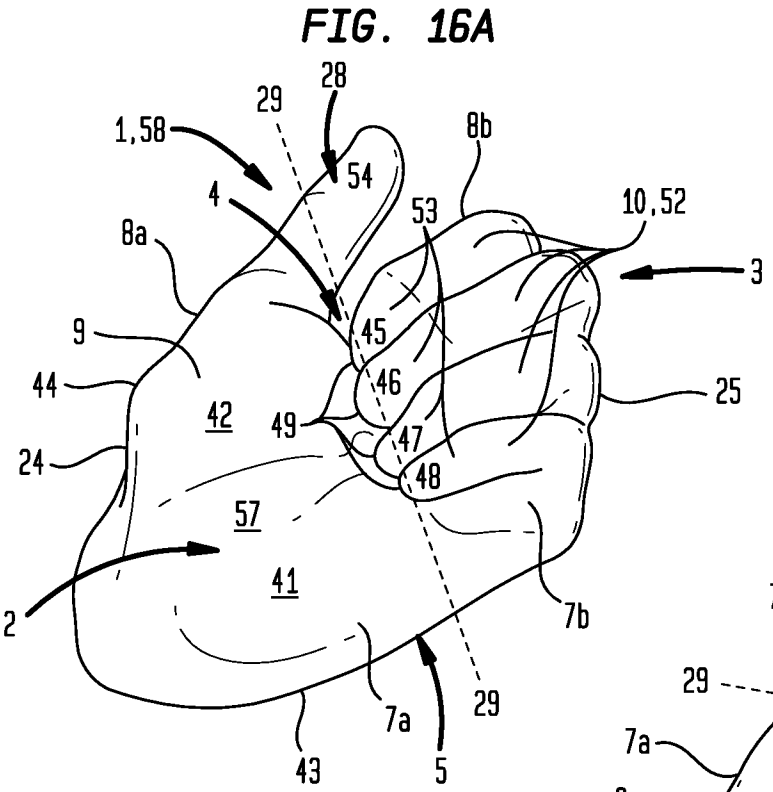
FIG. 16A is a perspective view of a left handed embodiment of the inventive spine mobilization apparatus having particular elements shaped like the human hand.
Figure 16B:
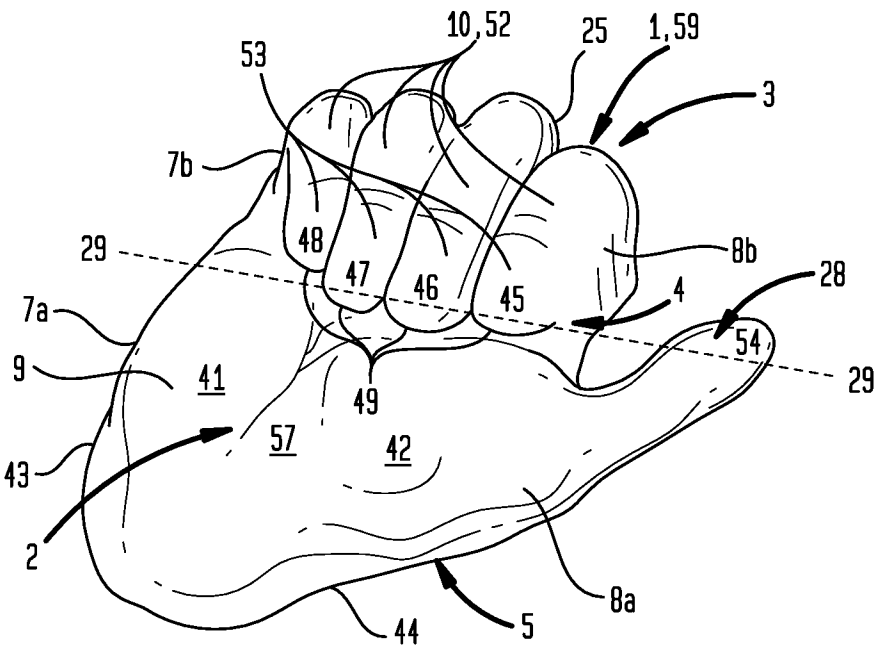
FIG. 16B is a perspective view of a right handed embodiment of the inventive spine mobilization apparatus having particular elements shaped like the human hand.
Figure 18:
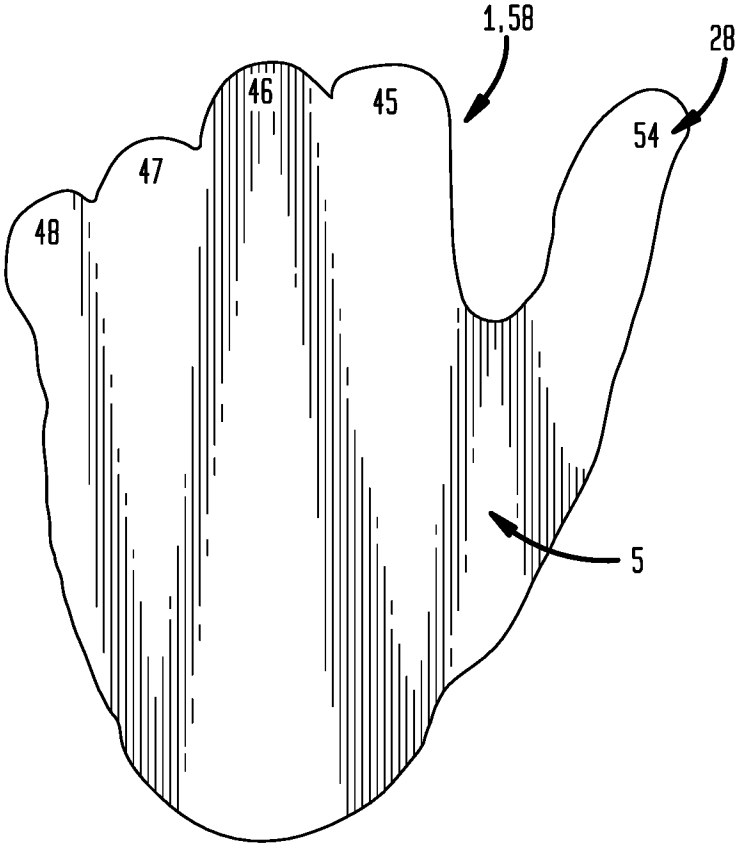
FIG. 18 is a bottom plan view of a left handed embodiment of the inventive spine mobilization apparatus shown in FIG. 16A.
Figure 17:
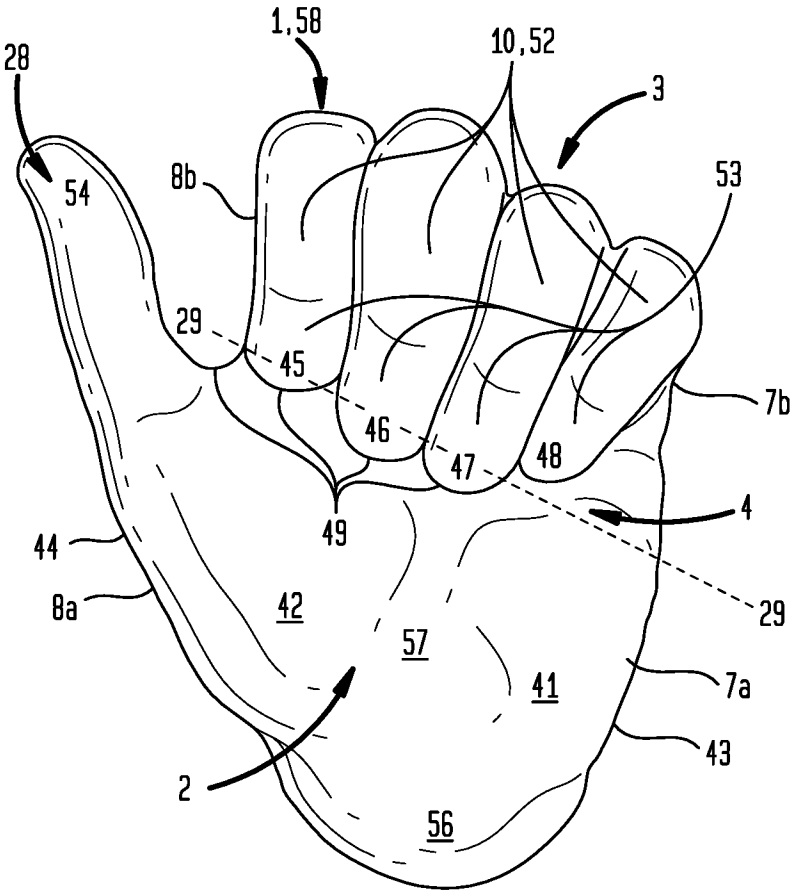
FIG. 17 is a top plan view of a left handed embodiment of the inventive spine mobilization apparatus shown in FIG. 16A.
Figure 19:
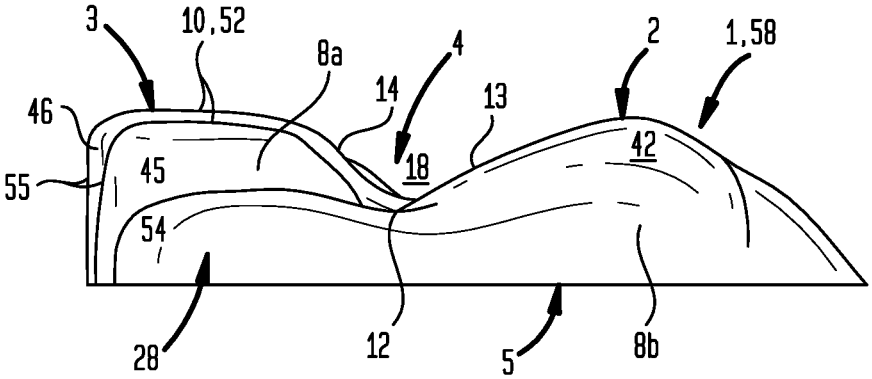
FIG. 19 is a first side view of a left handed embodiment of the inventive spine mobilization apparatus shown in FIG. 16A.
Figure 20:
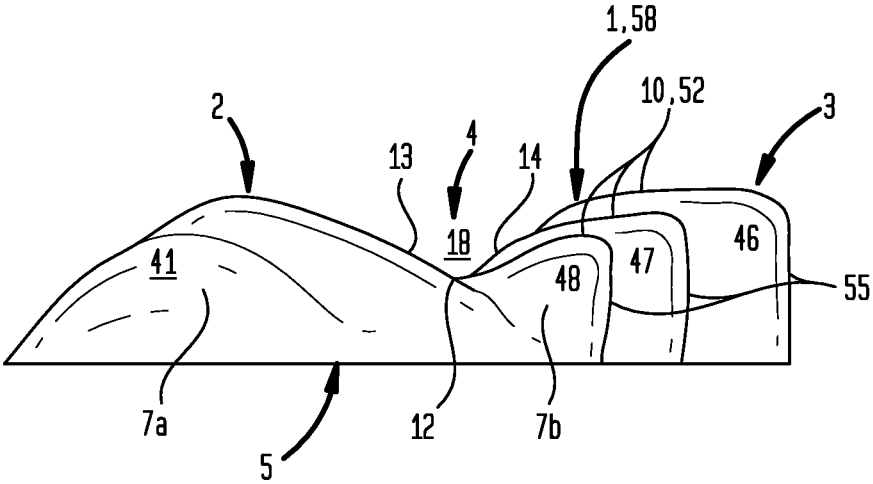
FIG. 20 is a second side view of a left handed embodiment of the inventive spine mobilization apparatus shown in FIG. 16A.
Figure 21:
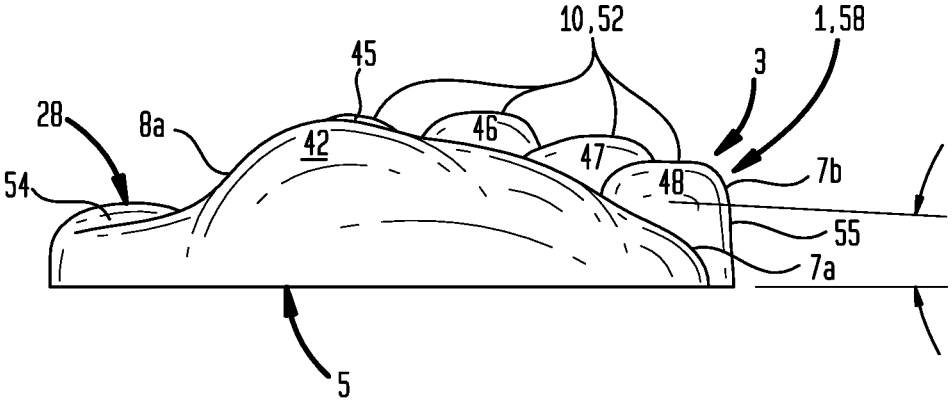
FIG. 21 is a first end view of a left handed embodiment of the inventive spine mobilization apparatus shown in FIG. 16A.
Figure 22:
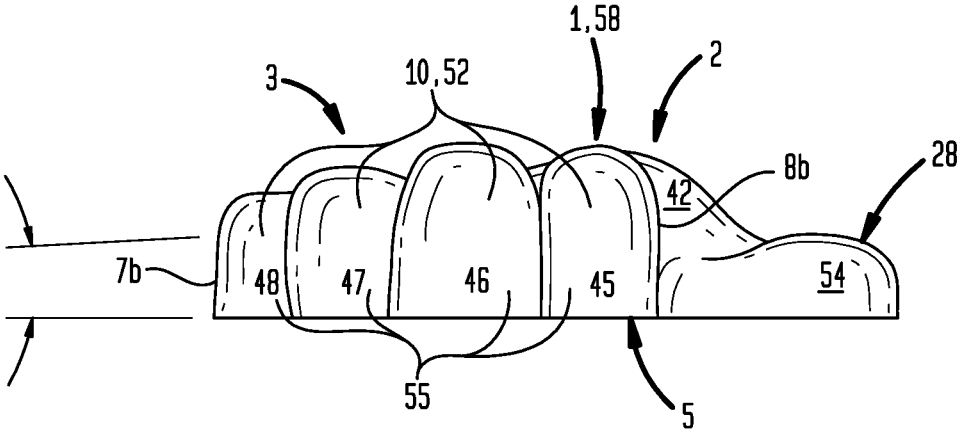
FIG. 22 is a second end view of a left handed embodiment of the inventive spine mobilization apparatus shown in FIG. 16A.

Now referring primarily to FIGS. 16 through 29 and referring to FIG. 15, particular embodiments of the spinal support apparatus (1) above described can, but need not necessarily, have various elements shaped as portions of a human hand (39)(particular creases, segments and portions of the human hand (39) shown in the example of FIG. 15). The first lateral spinal support portion (2), can but need not necessarily, have a configuration shaped like a portion of a palmer surface (40) of the human hand (39) including the hypothenar eminence (41) and a thenar eminence (42) disposed between an ulnar border (43) and a radial border (44) of the human hand (39) to correspond to or provide the first lateral spinal support face (9). The second lateral spinal support portion (3), can but need not necessarily, have a configuration shaped like the four fingers (45)(46)(47)(48) (index finger (45), middle finger (46), ring finger (47), and little finger (48)) of the human hand (39) curled to contact each corresponding fingertip (49) with the palmer surface (40) of the human hand (39) (as shown in the example of FIGS. 16A and 16B) at about the proximal palmer crease (50) to dispose the dorsal surface (51)(opposite the palmer surface (40)) of the middle phalanx (52) of each four fingers (45)(46)(47)(48) over the palmer surface (40) to correspond to or provide the second lateral spinal support face (10) of the spinal support apparatus (1). The medial recessed portion (4) can, but need not necessarily, be configured like the dorsal surface (51) of each distal phalanx (53) of each of the four fingers (45)(46)(47)(48) extending downwardly to join the palmer surface (40) of the human hand (39) and the palmer surface (40) extending upwardly from the distal phalanx (53) of each of the four fingers (45)(46)(47)(48) joining the palmer surface (40) toward the thenar eminence (42). The recess base (12) correspondingly disposed along the longitudinal axis (29) defined by the intersection of the distal phalanx (53) of each of the four fingers (45)(46)(47)(48) with the palmer surface (40). The axial spinal support member (28) which projects outward from the first lateral spinal support second end (8*a*) to cross the longitudinal axis (29) of the medial recessed portion (4), can but need not necessarily, have a configuration shaped like the thumb (54) of the human hand (39) extending outwardly from the thenar eminence (42) at an angle which crosses the longitudinal axis (29) defined by the intersection of the distal phalanx (53) of each of the four fingers (45)(46)(47)(48) with the palmer surface (40). The dorsal surface (51) of the hand opposite the palmer surface (40) corresponds to or provides the flat coextensive base (5) of the spinal mobilization apparatus (1). The first and second lateral sides (24)(25) extending upward from the coextensive base (5) can, but need not necessarily, be correspondingly shaped like the dorsal surface (51) of the proximal phalanx (55) of each of the four fingers (45)(46)(47)(48) and the portion of the hypothenar eminence (41) and thenar eminence (42) upwardly extending from the wrist (56).

Again referring primarily to FIGS. 16 through 29, as to particular embodiments, the first lateral spinal support portion (2) having a configuration shaped like a portion of a palmer surface (40) of the human hand (39) including the hypothenar eminence (41) and a thenar eminence (42) can correspond to the first lateral spinal support face (9) having substantially the same height between the ulnar border (43) of the human hand (39)(corresponding to the first lateral spinal support first end (7*a*)) and the radial border (44) of the human hand (39) (corresponding to the first lateral spinal support second end (8*a*)).

Similarly, the second lateral spinal support portion (3) having a configuration shaped like the four fingers (45)(46)(47)(48) (index finger (45), middle finger (46), ring finger (47), and little finger (48)) of the human hand curled to contact each fingertip (49) with the palmer surface (40) of the human hand (39) disposing the dorsal surface (51) of the middle phalanx (52) over the palmer surface (40) can provide the second lateral spinal support face (10) having substantially the same height between the ulnar border (43) and radial border (44) of the human hand (39).

The lateral spinal support first ends (7*a*)(7*b*) can correspond to the ulnar border (43) and the lateral spinal support second ends (8*a*)(8*b*) can be disposed at the radial border (44) can, but need not necessarily be, substantially the same height disposing each of the first lateral support face (9) afforded by the hypothenar eminence (41) and a thenar eminence (42) and second lateral spinal support face (10) afforded by the dorsal surface (51) of the middle phalanx (52) of the four fingers (45)(46)(47)(48) in substantially horizontal relation to the base (5) at the about the same height.

As to particular embodiments, the first lateral spinal support portion (2) having a configuration shaped like a portion of a palmer surface (40) of the human hand (39) including the hypothenar eminence (41) and a thenar eminence (42) and the second spinal support portion (3) afforded by the dorsal surface (51) of the middle phalanx (52) of the four fingers (45)(46)(47)(48) can provide first and second lateral spinal support faces (9)(10) which taper axially toward the base (5) between the radial border (44) of the human hand (39)(corresponding to the first lateral spinal support first end (7*a*)) and the ulnar border (43) of the human hand (39) (corresponding to the first lateral spinal support second end (8*a*)).

Figure 23B:
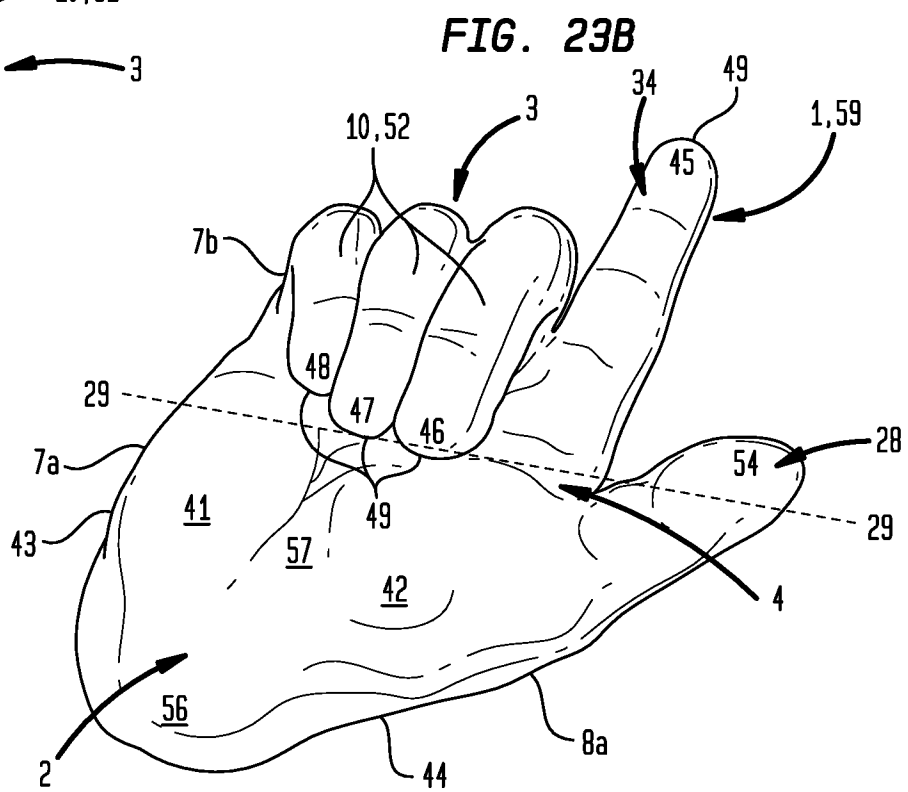
FIG. 23B is a perspective view of a right handed embodiment of the inventive spine mobilization apparatus having particular elements shaped like the human hand.
Figure 23A:
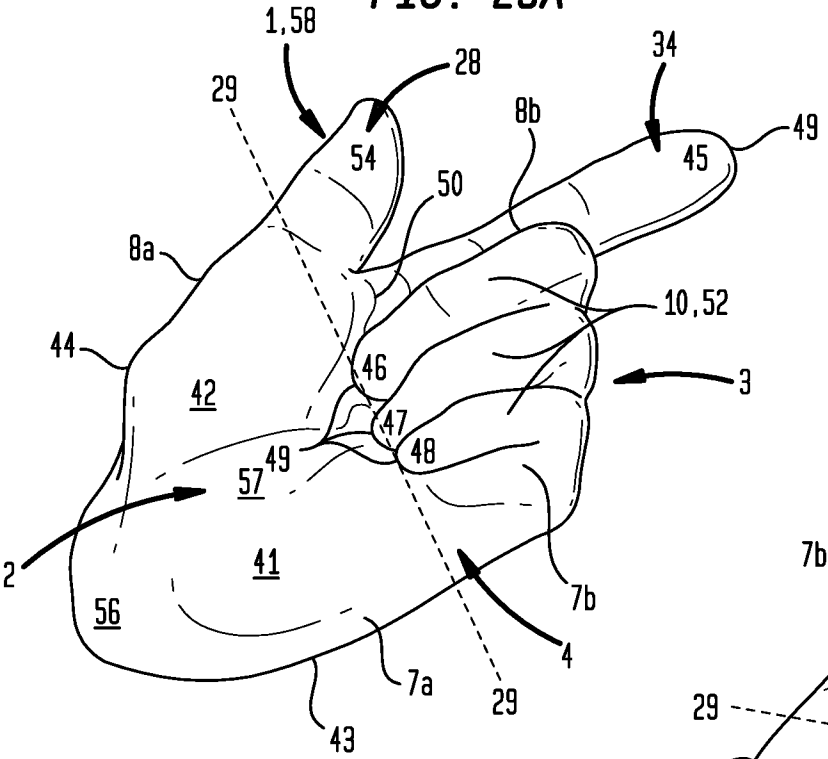
FIG. 23A is a perspective view of a left handed embodiment of the inventive spine mobilization apparatus having particular elements shaped like the human hand.
Figure 25:
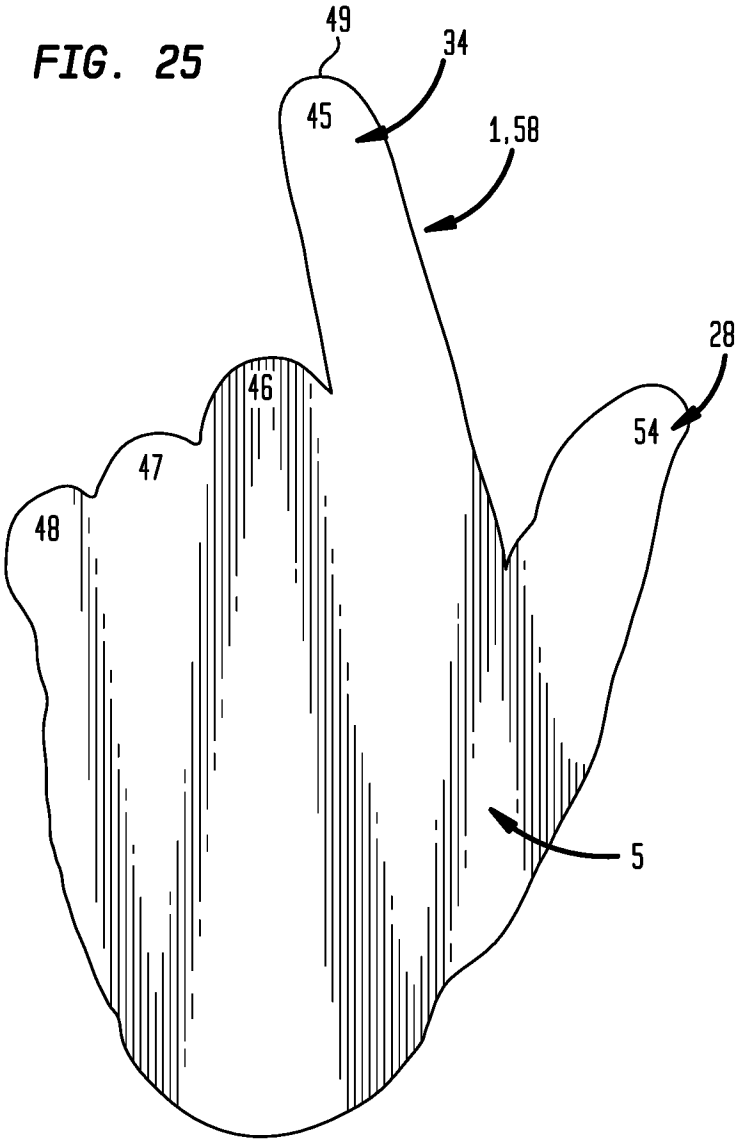
FIG. 25 is a bottom plan view of a left handed embodiment of the inventive spine mobilization apparatus shown in FIG. 23A.
Figure 24:
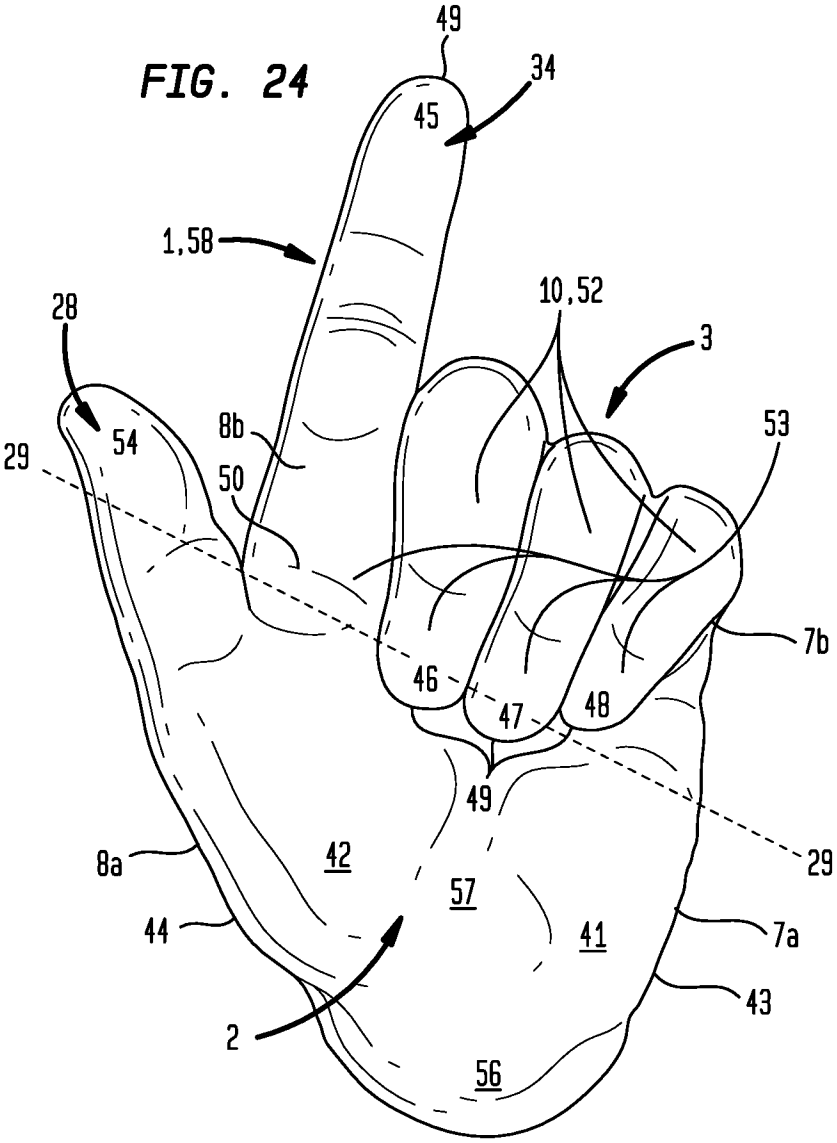
FIG. 24 is a top plan view of a left handed embodiment of the inventive spine mobilization apparatus shown in FIG. 23A.
Figure 26:
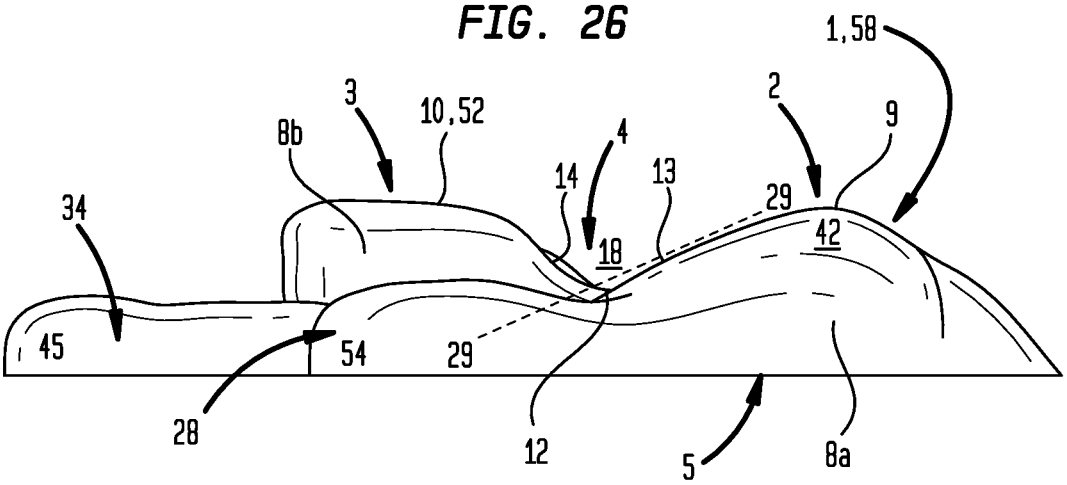
FIG. 26 is a first side view of a left handed embodiment of the inventive spine mobilization apparatus shown in FIG. 23A.
Figure 27:
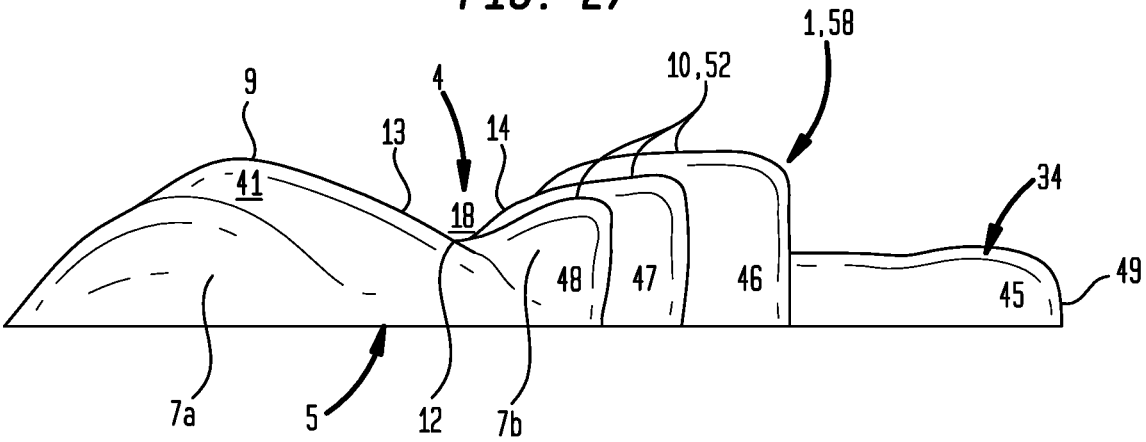
FIG. 27 is a second side view of a left handed embodiment of the inventive spine mobilization apparatus shown in FIG. 23A.
Figure 28:
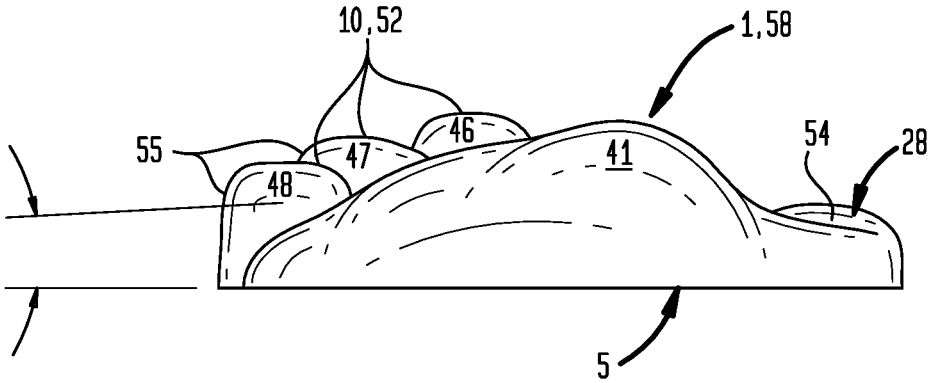
FIG. 28 is a first end view of a left handed embodiment of the inventive spine mobilization apparatus shown in FIG. 23A.
Figure 29:
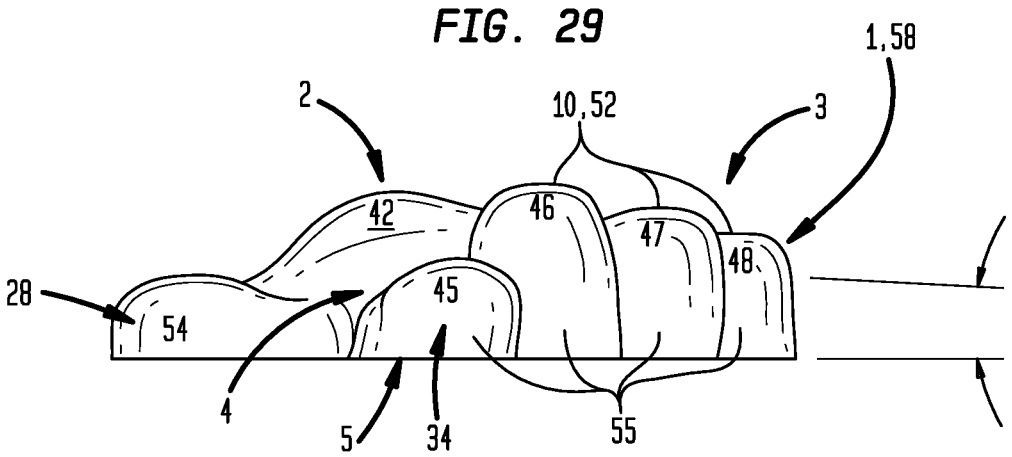
FIG. 29 is a second end view of a left handed embodiment of the inventive spine mobilization apparatus shown in FIG. 23A.

As to particular embodiments, the second lateral spinal support portion (3), can but need not necessarily, have a configuration shaped like the three fingers (46)(46)(48) (middle finger (46), ring finger (47), and little finger (48)) curled to contact each fingertip (49) with the palmer surface (40) of the human hand (39) (as shown in the example of FIGS. 23A and 23B at about the proximal palmer crease (50)) to dispose the dorsal surface (51) of the each middle phalanx (52) over the palmer surface (40) to correspond to or provide the second lateral spinal support face (3) of the spinal support apparatus (1). The lateral spinal support member (34) can be configured as the index finger (45) projecting outward from the palm (57) adjacent the curled middle finger (46) and extending beyond the dorsal surface (51) of the proximal phalanx (55).

Now referring generally to FIGS. 1 through 29, each of the various embodiments whether or not configured or shaped like the human hand (39) can be achieved as a chiral object or have left handedness (58) or right handedness (59).

Figure 31:
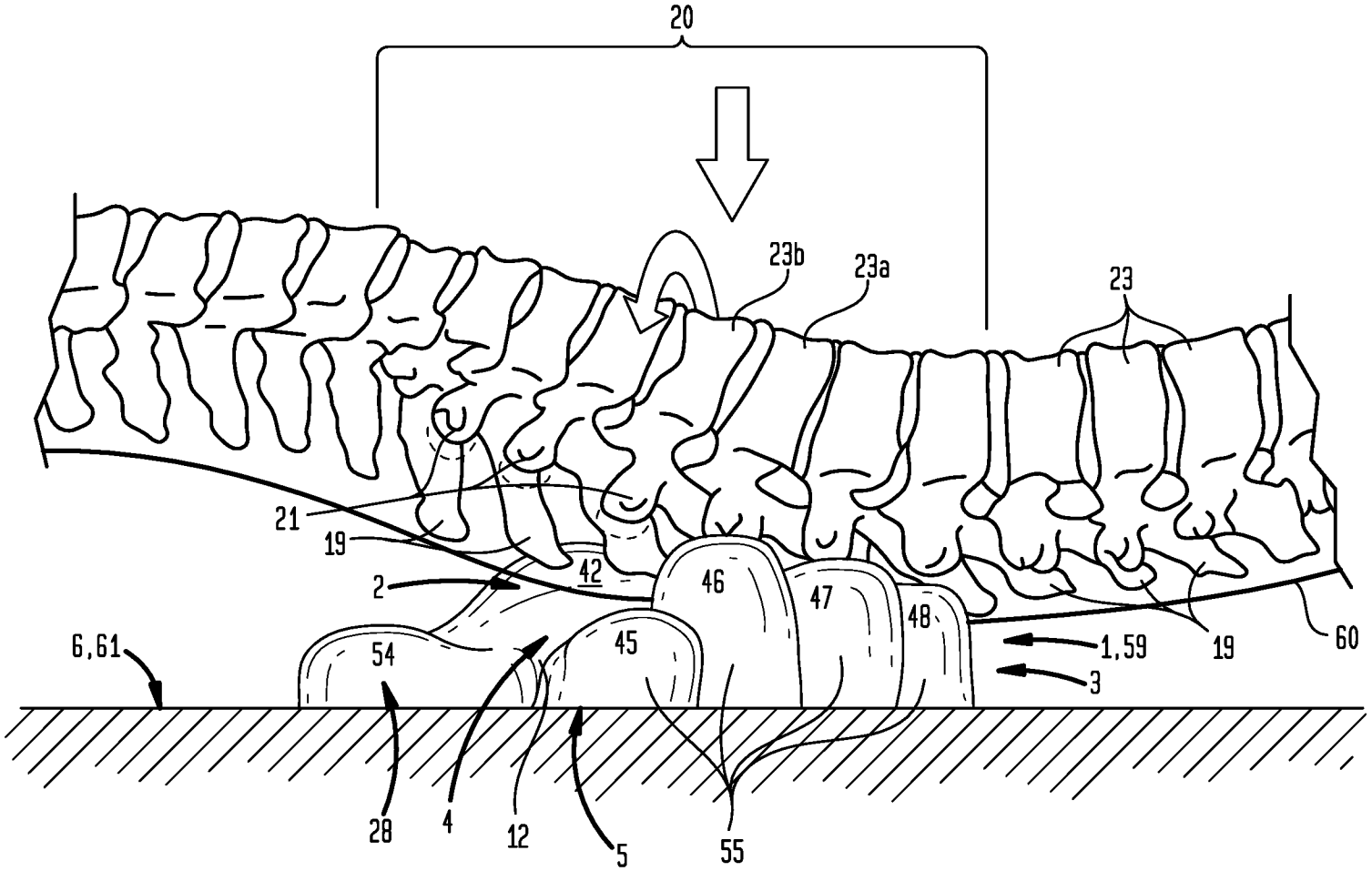
FIG. 31 is an illustration of a method of using the left handed embodiment of the inventive spine mobilization apparatus shown in FIG. 23A.
Figure 32:
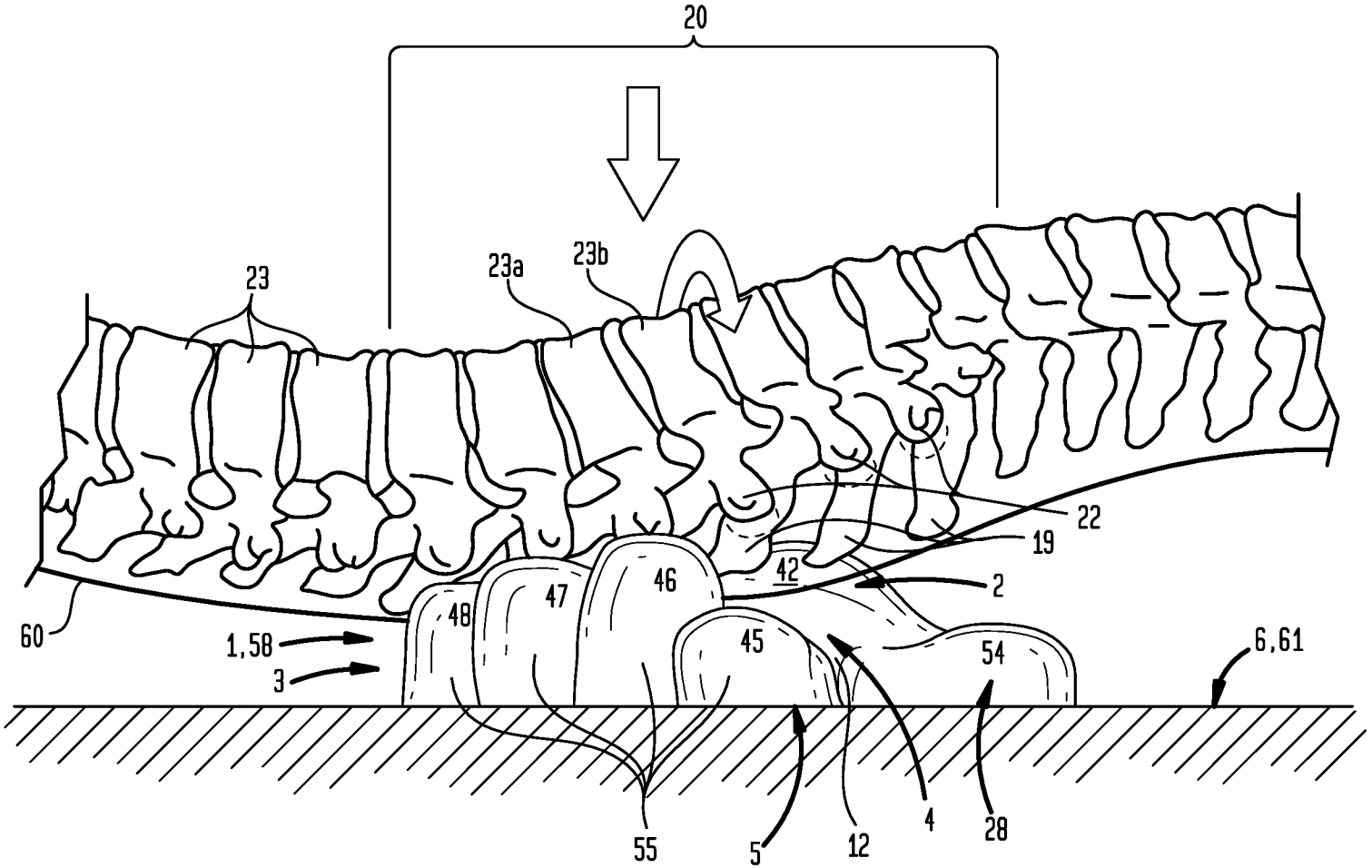
FIG. 32 is an illustration of a method of using the right handed embodiment of the inventive spine mobilization apparatus shown in FIG. 23B.

Now referring primarily to FIGS. 30 through 32, methods of using embodiments of the spine mobilization apparatus (1) are shown. As to the embodiment of FIG. 30, a patient (60) can lie supine face upward to position a spinal segment (20) with the plurality of spinous processes (19) of a spine segment (20) within the medial portion open space (18) with the first and second lateral spinal support portions (2)(3) each supporting one of two transverse processes (21)(22) projecting from each vertebrae (23) on opposite sides of each corresponding spinous process (19) of spine segment (20).

Now referring primarily to FIG. 30, as to certain embodiments of the spine mobilization apparatus (1), above described, in which the lateral spinal support first and second ends (7*a*)(7*b*)(8*a*)(8*b*) are coextensive (are not offset), posteroanterior mobilization of the vertebra (23) (largely confined to the sagittal plane of the spine) can be performed by movement of a pair of vertebrae (23*a*)(23*b*) within the physiological range of motion with the second ends (8*a*)(8*b*) supporting the first of the pair of vertebrae (23*a*) proximate the sagital plane between the first vertebrae (23*a*) and the second vertebrae (23*b*) of the pair of vertebrae (23*a*)(23*b*). The therapist may use slow, passive movements, starting with a small range and gradually increasing to a larger range of motion within the physiological range of motion of the pair of vertebrae (23*a*)(23*b*).

Now referring primarily to FIGS. 31 and 32, as to certain embodiments of the spine mobilization apparatus (1), above described, in which the lateral spinal support first ends (7*a*)(7*b*) are coextensive (are not offset), and the lateral spinal support second ends (8*a*)(8*b*) are offset, as above described, and can, but need not necessarily, include the lateral spinal support member which projects laterally outward from the first lateral spinal support portion (2) adjacent to the second lateral spinal support second end (8*b*) and extending a distance beyond the second lateral side (25) of the second spinal support portion (3) can be used to more readily, or efficaciously effect rotational mobilization between a pair of vertebrae (23*a*)(23*b*) which involves complex three dimensional movements and loading resulting in axial rotation of at least one of the pair of vertebrae (23*a*)(23*b*). In this regard, embodiments of the spinal support apparatus (1) in the left handed configuration can advantage axial rotation in the clockwise direction and embodiments of the spinal support apparatus (1) in the right handed configuration can advantage axial rotation in the counter clockwise direction.

As can be easily understood from the foregoing, the basic concepts of the present invention may be embodied in a variety of ways. The invention involves numerous and varied embodiments of a spinal support apparatus (1) and methods for making and using such spinal support apparatus (1) including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support" and even a "means for supporting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the spinal support apparatuses herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A spinal support apparatus, comprising:

a first lateral spinal support portion;

a second lateral spinal support portion;

a medial recessed portion joining said first and second lateral spinal support portions, said medial recessed portion configured to receive a plurality of spinous processes of the spine with said first lateral spinal support portion and said second lateral spinal support portion each configured to support one of two transverse processes projecting from each vertebrae on of each corresponding spinous process of said spine; and wherein the first lateral spinal support portion and the second lateral spinal support portion terminate coextensively at a lateral spinal support first end side and terminate coextensively at a lateral support second end side, wherein a height of the lateral support first end side is higher than a height of the lateral spinal support second end side, and wherein said medial recessed portion comprises a recess base extending from the lateral spinal support first end side to the lateral support second end side, wherein a height of the recess base at the lateral spinal support first end side is higher than a height of the recess base at the lateral spinal support second end side, and an axial spinal support member configured to support a portion of the spine that extends beyond said lateral spinal support first end side to reduce or avoid excessive posteroanterior mobilization of a vertebrae in a sagittal plane between supported and unsupported spinal segments, wherein the axial spinal support member projecting from said lateral spinal support first end side and is angled relative to the lateral spinal support first end side, wherein a bottom surface of the axial spinal support member and a bottom surface of the first lateral spinal support portion and the second lateral spinal support portion form a single flat surface, wherein a height of the axial spinal support member is about the same as the height of the recess base at the lateral spinal support first end side and the height of the axial spinal support member is shorter than the height of the lateral spinal support first end side.

2. The spinal support apparatus of claim 1, wherein the recess base joining a pair of ascending recess sidewalls which correspondingly join said first lateral spinal support portion and said second lateral spinal support portion.

3. The spinal support apparatus of claim 1, wherein the axial spinal support member comprises an axial spinal support member first side opposite an axial spinal support member second side, said axial spinal support member projecting from said first lateral spinal support portion or said second lateral spinal support portion, said axial spinal support member first and second sides continuously outwardly extending across a longitudinal axis of said medial recessed portion.

* * * * *